United States Patent [19]

Backlund et al.

[11] 4,401,965

[45] Aug. 30, 1983

[54] THERMAL SWITCH

[75] Inventors: Sven Backlund, Shoreview; Forrest R. Grimm, Golden Valley, both of Minn.

[73] Assignee: Minnesota Mining and Manufacturing Company, Saint Paul, Minn.

[21] Appl. No.: 367,380

[22] Filed: Apr. 12, 1982

[51] Int. Cl.[3] ..... H01H 37/76

[52] U.S. Cl. ..... 337/408; 337/407; 337/409

[58] Field of Search ..... 337/408, 407, 409

[56] References Cited

U.S. PATENT DOCUMENTS

| | | | |
|---|---|---|---|
| 3,519,972 | 7/1970 | Merrill | 337/407 |
| 4,060,787 | 11/1977 | Budnik | 337/409 |
| 4,145,654 | 3/1979 | Grimm | 337/407 |
| 4,246,564 | 1/1981 | Olson et al. | 337/408 |

*Primary Examiner*—Harold Broome

*Attorney, Agent, or Firm*—Cruzan Alexander; Donald M. Sell; Terryl K. Qualey

[57] ABSTRACT

A single use thermal switch having a tubular casing within which a mechanical isolation cage is axially movable. The cage is normally urged by a helical compression spring against a fusible pellet which melts at a temperature at which it is desired to disconnect the electrical circuit. An electrically conductive contact member extending transversely through the isolation cage is normally urged by a helical compression spring toward one end of the cage and against the end of one electrical lead that is coaxial with the casing. The contact member is foldable along a line across its center. The force of the contact member pressed against the end of the lead urges the contact member to fold to cause the ends thereof to be forced against the inside wall of the casing to establish electrical connection between the casing and the lead through the contact member.

3 Claims, 6 Drawing Figures

THERMAL SWITCH

FIELD OF THE INVENTION

The present invention relates to a single use thermal switch having a fusible pellet that melts at a predetermined temperature permitting an electrical contact member to move to break the electrical circuit.

BACKGROUND OF THE INVENTION

The prior art includes a number of different configurations for single use or one shot thermal switches having fusible pellets that melt at a predetermined temperature, as illustrated by U.S. Pat. Nos. 3,180,958; 3,281,559; 3,519,972; 3,924,218; 4,060,787; 4,068,204; 4,145,654; 4,246,561 and 4,246,564. Several million switches of the type illustrated in FIGS. 1–6 of U.S. Pat. No. 3,519,972 and in U.S. Pat. No. 4,060,787 are utilized each year in small home appliances subject to overheating upon failure, such as coffee makers and hair dryers. These most popular designs, and several of the others, utilize a contact member that is axially slidable within the tubular casing and has a resilient periphery that contacts the inside wall of the casing with a constant radial force. The contact member normally contacts the end of the insulated lead to complete the circuit from the case through the contact element to the lead and upon melting of the fusible pellet the disc is pushed away from the lead to disconnect the circuit. This design has proven highly reliable when the parts are within tolerance and are properly assembled within the switch. However, since the pressure exerted by the periphery of the contact member against the casing is only necessary to reliably complete the electrical connection in the normal state, it would be most desirable if that force would diminish when the temperature was reached at which it was desired to open the circuit so that the contact member could more easily slide in the casing to move away from the electrical lead and disconnect the circuit.

SUMMARY OF THE INVENTION

The present invention provides a thermal switch having a tubular, electrically and thermally conductive metal casing. A first electrically conductive lead is joined to and extends from one end of the metal case to seal off the end and make electrical connection to the casing. An insulative ceramic bushing at the opposite end of the casing, has its bore coaxial with the casing and seals the end of the casing. A second electrically conductive lead extends into the casing through the bore of the ceramic bushing and out of the casing to insulate the lead from the casing and to permit electrical connection thereto outside the casing. A normally solid, fusible pellet is within the casing adjacent the one end. A mechanical isolation cage is within the casing and has first and second parallel ends perpendicular to the axis of the casing, the cage being axially slidable within the casing and having a central opening in its first end through which the second lead normally freely passes. A first helical compression spring is between the ceramic bushing and the first end of the cage and urges the cage against the fusible pellet. An electrically conductive contact member extends through the cage in a direction perpendicular to the axis of the casing and has its ends terminating in close proximity to the side walls of the casing. The contact member is foldable along a line across its center and has a portion to each side of its center that has a component perpendicular to the axis of the casing and a component parallel to the axis of the casing. A second helical compression spring is between the second end of the cage and the contact member and presses the contact member against the end of the second lead to cause the contact member to fold until its ends contact the side wall of the casing.

The pressure of the second helical compression spring forcing the contact member against the second lead and the resulting folding of the contact member forceably presses the ends of the contact member against the side wall of the casing to establish reliable electrical contact from the casing through the contact member to the insulated lead. When the fusible pellet is melted the mechanical isolation cage is moved axially by the first compression spring until it contacts the contact member at which time it carries the contact member away from the second lead immediately relieving the force between the lead and the contact member and thereby diminishing the pressure of the ends of the contact member against the side wall of the casing to permit the contact member to be more easily slid axially down the casing to break the electrical contact.

THE DRAWING

DESCRIPTION OF THE PREFERRED EMBODIMENT

Figure 1:
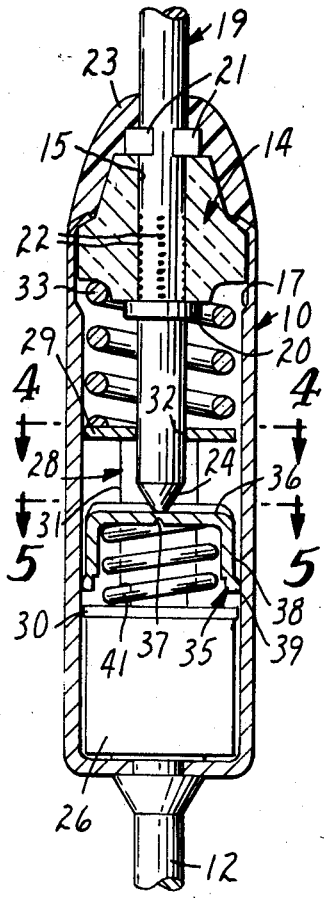
FIG. 1 is a longitudinal cross-sectional view of a thermal switch constructed in accodance with the present invention in its normal state as manufactured.

The thermal switch of the present invention has a tubular, electrically and thermally conductive metal casing 10. A first electrically conductive lead 12 is joined to and extends from one end of the metal casing to seal off the end and make electrical connection to the casing. In the illustrated embodiment the end of the casing is bent perpendicular to its axis and the lead 12 is swaged or riveted to the casing 10.

An insulative ceramic bushing 14 seals the opposite end of the casing 10 and has its bore 15 coaxial with the casing. The bushing 14 is retained in place in the casing 10 between a shoulder 17 on the inner wall of the casing 10 and the end of the casing which is bent over the end of the bushing 14 during assembly. A second electrically conductive lead 19 extends into the casing 10 through the bore 15 of the ceramic bushing 14 and out of the casing to insulate the lead from the casing and to permit electrical connection to its exposed end. The second lead 19 is formed with an enlarged ring 20 to abut the inner surface of the ceramic bushing 14. A pair of ears 21 are formed on the second lead 19 adjacent the outer end of the bushing 14 after insertion of the lead through the bushing to prevent the lead from movement axially with respect to the bushing. The ears are each formed starting generally at less than a third of the diameter of the undeformed lead 19 so as not to unduly weaken this portion of the lead in bending. Radial indentations 22 are formed in the second lead 19 in the area within the bushing 14 and a sealing resin 23 is applied over the end of the ceramic bushing to seal the end of the switch. A portion of the resin seeps down the bore 15 of the ceramic bushing 14 and into the indentations 22 in the lead 19 and when the resin hardens in the indentations 22 it aids in preventing twisting of the lead 19 as described in U.S. Pat. No. 4,060,787. The end 24 of the lead 19 within the casing 10 has a truncated conical shape for a purpose which will be hereinafter described.

A normally solid, fusible pellet 26 is positioned within the casing 10 adjacent the end having the first lead 12. The fusible pellet 26 is chosen to have a melting temperature corresponding to a temperature that indicates failure of the electrical device in which the thermal switch is to be used.

A mechanical isolation cage 28 is axially slidable within the casing 10. The cage 28 has disc-shaped parallel ends 29 and 30 joined by opposed arcuate edge strips 31. The cage 28 is formed from a strip of metal with the upper end 29 being at the center of the strip and the ends of the strip each forming a half circle and being bent toward each other to define the lower end 30 of the cage 28. The upper end 29 of the cage 28 is formed with a central aperture 32 through which the second lead 19 freely passes. A first helical compression spring 33 between the ceramic bushing 14 and the first or upper end 29 of the cage 28 urges the cage against the fusible pellet 26.

An electrically conductive contact member in the form of a cup 35 extends transversely through and is coaxial with the cage 28. The cup has a bridge piece 36 perpendicular to the axis of the casing 10 which is foldable along a line 37 across its center. The fold line 37 is created by a V-shaped reduction in the thickness of the material of the bridge 36 from the lower surface of the bridge. The cup has an arcuate side wall 38 at each end of the bridge 36 extending generally parellel to the axis of the casing 10 from the bridge toward the second or lower end 30 of the cage 28 in close proximity to the side wall of the casing 10. The free ends of the side walls 38 of the cup 35 are formed with radially protruding rounded edges 39 for contacting the side wall of the casing 10. A second helical compression spring 41 is between the second or lower end 30 of the cage 28 and the bridge 36 of the cup 35 and presses the center of the bridge 36 against the end 24 of the second lead 19.

The contact member may be shaped other than in the illustrated cup configuration. For example, it may be a straight piece with arcuate ends for contacting the inner wall of the casing folded along its center fold line so that in a longitudinal cross-sectional view through the switch it would appear V-shaped. The portion of the contact member to each side of the fold line would then have components both perpendicular and parallel to the axis of the casing 10 even though not represented by distinct parts as the bridge 36 and side wall 38 in the illustrated embodiment.

In normal use, the ends of the leads 12 and 19 are connected into an electrical circuit of a device which is to be protected against overheating. The switch will normally appear as in FIG. 1 with the conductive contact cup 35 pressed against the end 24 of the second lead 19. The truncated conical shape of the end 24 of the lead 19 concentrates the force applied by the lead 19 to the bridge 36 because of the opposed force of the spring 41 to the fold line 37 of the bridge 36. This concentrated force causes the bridge to fold downward on fold line 37 causing the arcuate side walls 38 of the cup 35 to tilt outward until the rounded edges 39 thereof press against the side wall of the casing 10. The contact force of the edges 39 of the cup 35 with the casing 10 can be adjusted by proper choice of the spring 41. The contact force must be sufficiently high to produce a reliable electrical connection through the cup 35 so that electricity can normally flow between the leads 12 and 19 through the casing 10 and the cup 35.

Figure 2:
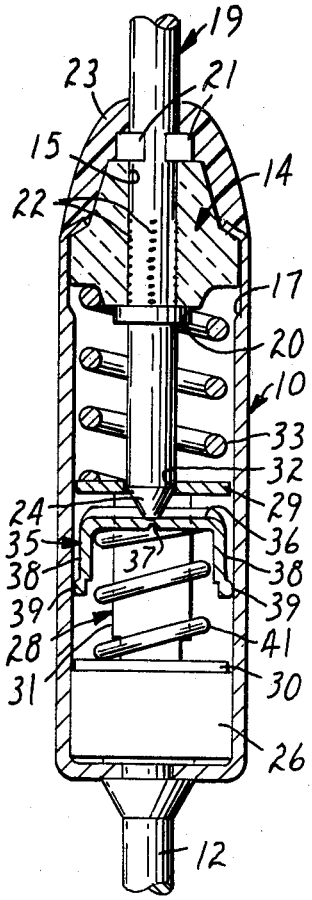
FIG. 2 is a view similar to that of FIG. 1 after the pellet has partially melted or sublimed.
Figure 3:
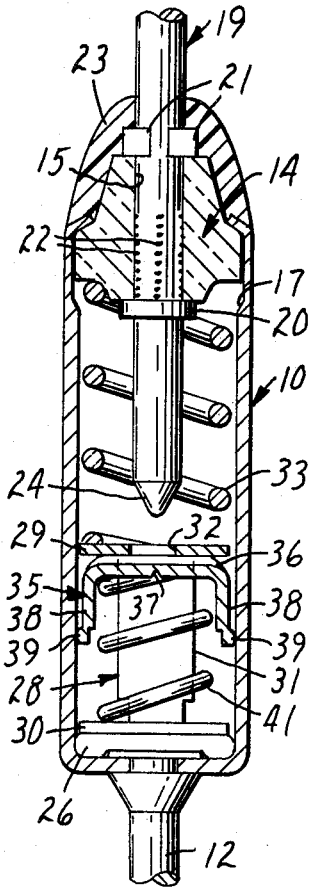
FIG. 3 is a view similar to that of FIGS. 1 and 2 after the pellet has melted and the circuit has been disconnected.
Figure 4:
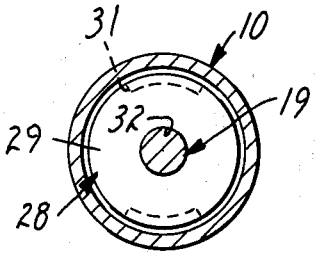
FIG. 4 is a transverse cross-sectional view taken along line 4—4 of FIG. 1.
Figure 5:
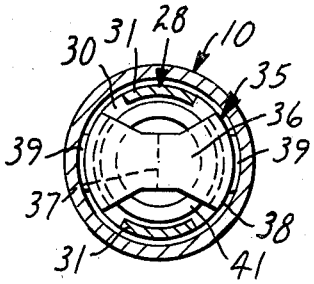
FIG. 5 is a transverse cross-sectional view taken along line 5—5 of FIG. 1.
Figure 6:
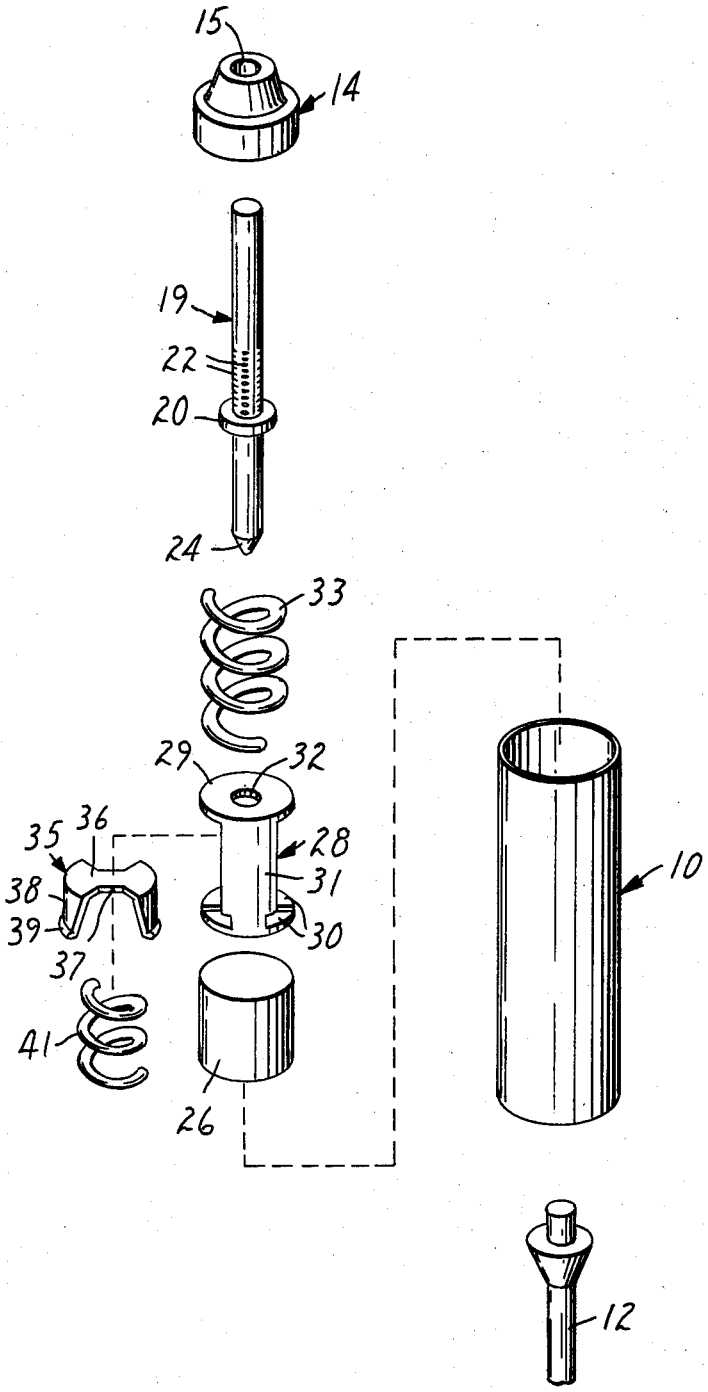
FIG. 6 is an exploded isometric view of the thermal switch illustrating the parts thereof.

One problem with available normally solid, fusible materials in current use is that over a period of time they will to a certain extent sublime and shrink even under normal conditions. As can be seen in FIG. 2, in the switch of the present invention even though the pellet 26 has shrunk, the contact cup 35 continues to be pressed against the second lead 19 to maintain the electrical circuit. Though the upper spring 33 extends and pushes the cage 28 downward following the pellet, the lower spring 41 also extends to accommodate the shrinkage of the pellet. When the predetermined melting temperature of the pellet 26 is reached the pellet very quickly melts and the upper spring 33 moves the cage 28 downward. The lower spring 41 continues to expand until the contact cup 35 comes into contact with the upper end 29 of the cage 28. After this point is reached the lower spring 41 exerts no further force that is transmitted to the second lead 19. Thus, the pressure is relieved at the fold line 37 of the cup 35 thereby removing the force pressing the edges 39 of the side walls 38 against the side wall of the casing 10. Continued movement of the cage 28 downward by the spring 33 thus carries the cup 35 downward with it breaking the electrical connection to the second lead 19. The contact pressure having been removed from the cup, it readily slides downward with the cage 28.

We claim:

1. A thermal switch comprising:

a tubular, electrically and thermally conductive metal casing, a first electrically conductive lead joined to and extending from one end of said metal casing to seal off said one end and make electrical connection to said casing, an insulative ceramic bushing at the opposite end of said casing, said bushing sealing the opposite end of said casing and having its bore coaxial with said casing, a second electrically conductive lead extending into said casing through the bore of said ceramic bushing and out of said casing to permit electrical connection thereto, a normally solid, fusible pellet within said casing adjacent said one end, a mechanical isolation cage within said casing having first and second parallel ends perpendicular to the axis of said casing, said cage being axially slidable within said casing and having a central opening in its first end adjacent said opposite end of said casing through which said second lead normally freely passes, a first helical compression spring between said ceramic bushing and said first end of said cage urging said cage against said fusible pellet, an electrically conductive contact member extending through said cage in a direction perpendicular to the axis of said casing and having its ends terminating in close proximity to the side walls of said casing, said contact member being foldable along a line across its center and having a portion to each side of its center that has a component perpendicular to the axis of said casing and a component parallel to the axis of said casing, and a second helical compression spring between said second end of said cage and contact member pressing said contact member against the end of said second lead to cause said contact member to fold until its ends contact the side wall of said casing.

2. The thermal switch of claim 1 wherein said contact member comprises a contact cup having a bridge piece perpendicular to the axis of said casing which is foldable along a line across its center and an arcuate side wall at each end of said bridge extending generally parallel to the axis of said casing from said bridge toward said second end of said cage in close proximity to the side wall of said casing, and wherein said second helical compression spring presses the center of said bridge against the end of said second lead.

3. The thermal switch of claim 2 wherein the free ends of said arcuate side walls of said electrically conductive cup are formed with radially protruding rounded edges for contacting the side wall of said casing.

* * * * *